US010760788B2

(12) United States Patent
Kuo et al.

(10) Patent No.: US 10,760,788 B2
(45) Date of Patent: Sep. 1, 2020

(54) METHOD OF COMBUSTING A SULFUR-CONTAINING CARBONACEOUS MATERIAL WITH ASH TREATMENT

(71) Applicant: CHANG GUNG UNIVERSITY, Taoyuan (TW)

(72) Inventors: Hsiu-Po Kuo, Taipei (TW); An-Ni Huang, Taoyuan (TW)

(73) Assignee: CHANG GUNG UNIVERSITY, Taoyuan (TW)

( * ) Notice: Subject to any disclaimer, the term of this patent is extended or adjusted under 35 U.S.C. 154(b) by 596 days.

(21) Appl. No.: 14/991,610

(22) Filed: Jan. 8, 2016

(65) Prior Publication Data

US 2017/0198907 A1 Jul. 13, 2017

(51) Int. Cl.

| | |
|---|---|
| ***F23J 7/00*** | (2006.01) |
| ***F23J 1/00*** | (2006.01) |
| ***F23J 9/00*** | (2006.01) |

(52) U.S. Cl.

CPC . *F23J 7/00* (2013.01); *F23J 1/00* (2013.01); *F23J 9/00* (2013.01)

(58) Field of Classification Search

CPC ..... F23J 1/00; F23J 7/00; F23J 9/00

See application file for complete search history.

(56) References Cited

U.S. PATENT DOCUMENTS 1,873,642 A * 8/1932 Guertler ..... C01F 7/20 209/2
2,606,127 A * 8/1952 Weber ..... C04B 28/16 106/672
3,472,619 A * 10/1969 Chelminski ..... C01B 25/22 423/157.4
3,820,970 A * 6/1974 Watkins ..... C01F 11/46 71/1
3,906,083 A * 9/1975 George ..... C01F 11/466 423/555
4,126,663 A * 11/1978 Pitts ..... C01G 31/003 423/144

(Continued)

FOREIGN PATENT DOCUMENTS

JP 54006014 A * 1/1979

OTHER PUBLICATIONS

Khan, T., et al; "Improving limestone utilization in circulating fluidized bed combustors through the reactivation and recycle of partially utilized limestone in the ash"; Conference 13. International conference on fluidized-bed combustion, Orlando, FL; May 7-10, 1995; pp. 831-840.*

(Continued)

*Primary Examiner* — Edelmira Bosques
*Assistant Examiner* — Logan P Jones
(74) *Attorney, Agent, or Firm* — Lewis Roca Rothgerber Christie LLP

(57) ABSTRACT

A method of combusting a sulfur-containing carbonaceous material with ash treatment includes: feeding a feed containing the sulfur-containing carbonaceous material and limestone into a furnace; combusting the feed in the furnace so as to generate preliminary fly and bottom ashes; hydrating the preliminary fly and bottom ashes to form a hydrated material; recycling the hydrated materials into the furnace so as to generate secondary fly and bottom ashes; and reacting the secondary fly and bottom ashes with a sulfuric acid solution.

4 Claims, 1 Drawing Sheet

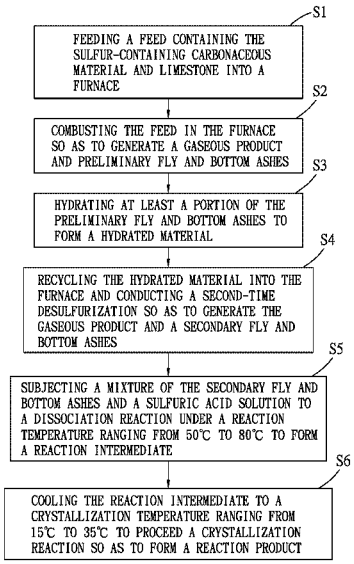

(56) References Cited

U.S. PATENT DOCUMENTS 4,130,627 A * 12/1978 Russ ..... C22B 7/02 205/592
4,185,080 A * 1/1980 Rechmeier ..... B01D 53/501 423/244.05
4,375,986 A * 3/1983 Pichat ..... C02F 11/008 106/706
4,411,879 A * 10/1983 Ehrlich ..... F23J 7/00 110/245
4,443,261 A * 4/1984 Nordqvist ..... C04B 28/141 106/772
4,622,071 A * 11/1986 Matsuura ..... C04B 18/06 106/15.05
5,358,760 A * 10/1994 Furlong ..... B28B 5/04 428/2
5,362,319 A * 11/1994 Johnson ..... C04B 7/12 106/697
6,290,921 B1 * 9/2001 Kuivalainen ..... B01D 53/346 423/210
2003/0044337 A1 * 3/2003 Furuya ..... B09B 3/00 423/244.08
2007/0000842 A1 * 1/2007 Collier ..... B09B 3/00 210/709
2008/0139868 A1 * 6/2008 Forrester ..... B03B 9/04 588/256

OTHER PUBLICATIONS

Grosso, Mario, et al; "A quantitative estimate of potential aluminium recovery from incineration bottom ashes"; Resources, Conservation and Recycling 55; 2011; pp. 1178-1184.*

Lee, Keat Teong, et al; "Preparation and characterization of sorbents prepared from ash (waste material) for sulfur dioxide (SO2) removal"; J Mater Cycles Waste Manag 7; 2005; pp. 16-23.*

Marquis, Denis Luc; "Reactivation of spent CFB limestone by hydration"; Thesis submitted to the University of New Brunswick; 1992.*

Wang, Yunquan, et al; "Comparative leaching experiments for trace elements in raw coal, laboratory ash, fly ash and bottom ash"; International Journal of Coal Geology 40; 1999; pp. 103-108.*

* cited by examiner

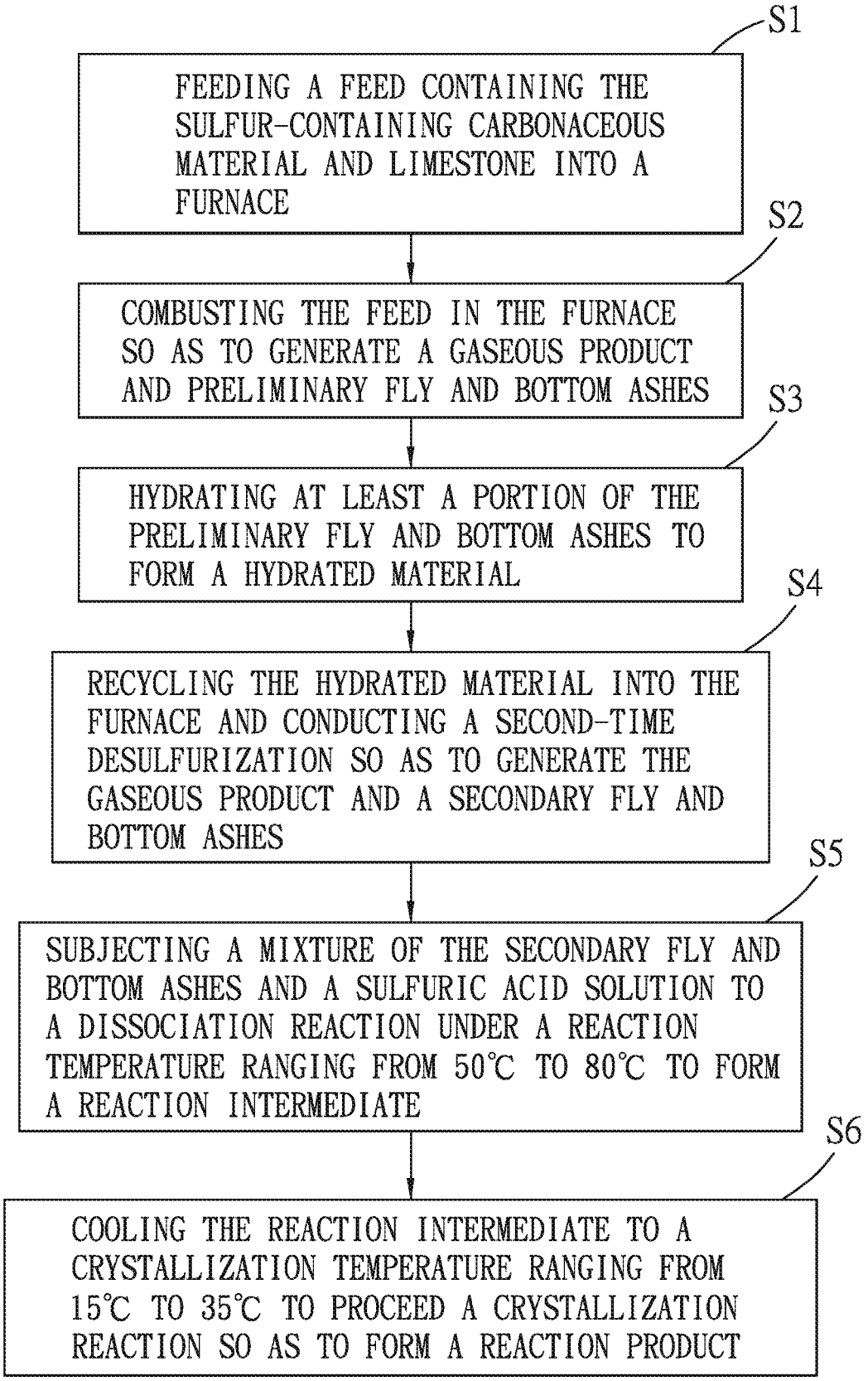
S1
FEEDING A FEED CONTAINING THE SULFUR-CONTAINING CARBONACEOUS MATERIAL AND LIMESTONE INTO A FURNACE
S2
COMBUSTING THE FEED IN THE FURNACE SO AS TO GENERATE A GASEOUS PRODUCT AND PRELIMINARY FLY AND BOTTOM ASHES
S3
HYDRATING AT LEAST A PORTION OF THE PRELIMINARY FLY AND BOTTOM ASHES TO FORM A HYDRATED MATERIAL
S4
RECYCLING THE HYDRATED MATERIAL INTO THE FURNACE AND CONDUCTING A SECOND-TIME DESULFURIZATION SO AS TO GENERATE THE GASEOUS PRODUCT AND A SECONDARY FLY AND BOTTOM ASHES
S5
SUBJECTING A MIXTURE OF THE SECONDARY FLY AND BOTTOM ASHES AND A SULFURIC ACID SOLUTION TO A DISSOCIATION REACTION UNDER A REACTION TEMPERATURE RANGING FROM 50℃ TO 80℃ TO FORM A REACTION INTERMEDIATE
S6
COOLING THE REACTION INTERMEDIATE TO A CRYSTALLIZATION TEMPERATURE RANGING FROM 15℃ TO 35℃ TO PROCEED A CRYSTALLIZATION REACTION SO AS TO FORM A REACTION PRODUCT

METHOD OF COMBUSTING A SULFUR-CONTAINING CARBONACEOUS MATERIAL WITH ASH TREATMENT

FIELD

This disclosure relates to a method of combusting a sulfur-containing carbonaceous material with ash treatment, more particularly to a method of combusting a sulfur-containing carbonaceous material and reacting secondary fly and bottom ashes with a sulfuric acid solution.

BACKGROUND

A circulating fluidized bed combustor (CFBC) may be used in different applications, such as thermal power generation, waste incineration and steam generation. The fuels that are commonly employed in the circulating fluidized bed combustor include fossil fuels, such as coals and petroleum cokes. However, an exhaust gas generated from the combustion of these fuels in the circulating fluidized bed combustor normally includes sulfur-containing materials, such as sulfur dioxide, which may cause acid rain.

Removal of sulfur from the sulfur-containing materials in a CFBC may be achieved by limestone (mainly composed of calcium carbonate, $CaCO_3$) that is directly injected into a furnace of the CFBC. Limestone can be thermally decomposed into quicklime (CaO) and carbon dioxide at around 600° C. Calcium oxide (CaO) reacts with sulfur dioxide and oxygen to produce calcium sulfate, thereby permitting desulphurization of the exhaust gas. The followings are reactions taken place during the CFBC in-situ desulphurization.

$$CaCO_3 \rightarrow CaO + CO_2$$

$$CaO + \tfrac{1}{2}O_2 + SO_2 \rightarrow CaSO_4$$

Combustion of sulfur-containing carbonaceous materials with the limestone by virtue of an in-situ desulfurization process normally generates a gaseous product, fly and bottom ashes. Those ashes are particles consisting of $CaCO_3$, CaO, $CaSO_4$, $Ca(OH)_2$, etc. The formation of calcium sulfate ($CaSO_4$) at the ash particle surface suppresses the core calcium oxide desulfurization reaction. Typically, the sulfurized calcium is less than 50%. Therefore, when fly ashes and bottom ashes are further converted to calcium sulfate dihydrate (gypsum, $CaSO_4.2H_2O$), a large amount of sulfuric acid is required.

As such, there is a need to further develop a CFBC desulfurization method for a sulfur-containing carbonaceous material which uses less amount of the sulfuric acid when the ashes are further converted to gypsum.

SUMMARY

Therefore, an object of the present disclosure is to provide a method of combusting a sulfur-containing carbonaceous material with ash treatment that can overcome the aforesaid drawback associated with the prior art.

According to this disclosure, there provides a method of combusting a sulfur-containing carbonaceous material with ash treatment. The method includes: feeding a feed containing a sulfur-containing carbonaceous material and limestone into a furnace; combusting the feed in the furnace so as to generate a gaseous product and preliminary fly and bottom ashes; hydrating at least a portion of the preliminary fly and bottom ashes to form a hydrated material; recycling the hydrated material into the furnace so as to generate the gaseous product and secondary fly and bottom ashes; and reacting the secondary fly and bottom ashes with a sulfuric acid solution.

BRIEF DESCRIPTION OF THE DRAWING

In drawing which illustrates an embodiment of the disclosure,

FIG. 1 is a diagram of the embodiment of a method of combusting a sulfur-containing carbonaceous material with ash treatment according to the disclosure.

DETAILED DESCRIPTION

Referring to FIG. 1, the embodiment of a method of combusting a sulfur-containing carbonaceous material with ash treatment includes:

(s1) feeding a feed containing the sulfur-containing carbonaceous material and limestone into a furnace, the limestone serving as a desulfurization agent;

(s2) combusting the feed in the furnace so as to generate a gaseous product and preliminary fly and bottom ashes;

(s3) hydrating at least a portion of the preliminary fly and bottom ashes to form a hydrated material;

(s4) recycling the hydrated material into the furnace and conducting a second-time desulfurization so as to generate the gaseous product and secondary fly and bottom ashes, the hydrated material serving as a desulfurization agent;

(s5) subjecting a mixture of the secondary fly and bottom ashes and a sulfuric acid solution to a dissociation reaction under a reaction temperature ranging from 50° C. to 80° C. to form a reaction intermediate; and (s6) after step (s5), cooling the reaction intermediate to a crystallization temperature ranging from 15° C. to 35° C. to proceed a crystallization reaction so as to form a reaction product.

In certain embodiments, the preliminary fly and bottom ashes contains 30 wt % to 60 wt % $CaSO_4$ based on the total weight of the preliminary fly and bottom ashes, and the secondary fly and bottom ashes contains 60 wt % to 85 wt % $CaSO_4$ based on the total weight of the secondary fly and bottom ashes. The reaction product includes a solid product and water. The solid product includes 80 wt % to 95 wt % of gypsum ($CaSO_4.2H_2O$) and 20 wt % to 5 wt % of carbon and other inorganic materials. The inorganic materials typically include silicon dioxide, alumina oxide and other minors. The minors may include CaS and impurities.

It is noted that, a relatively small amount of ions, such as $Ca^{2+}$ and $SO_4^{2-}$, are present in the water of the reaction product. It is advantageous that the water can be reused for mixing a concentrated sulfuric acid to form the sulfuric acid solution employed for the production of gypsum. As such, the method of the disclosure produces substantially no waste water.

In certain embodiments, the reaction intermediate has a pH value ranging from 2.0 to 3.0.

In certain embodiments, the sulfur-containing carbonaceous material may be petroleum cokes or coals.

The following examples are provided to illustrate the embodiment of the present disclosure, and should not be construed as limiting the scope of the disclosure.

EXAMPLES

Example 1(E1)

A sulfur-containing petroleum coke with a feeding rate of 42 ton/hr and limestone with a feeding rate of 30 ton/hr were added into a furnace of a CFBC. The furnace was heated to 900° C. so as to instantaneously generate a gaseous product and preliminary fly and bottom ashes at a rate of 30 ton/hr. 30 tons of the preliminary fly and bottom ashes were hydrated to form approximately 40 tons of hydrated materials. The hydrated materials were recycled into the CFBC furnace to conduct a second-time desulfurization so as to generate the gaseous product and secondary fly and bottom ashes.

50 kg of secondary fly ashes was mixed with 17.3 kg of 98 wt % sulfuric acid solution and 150 kg of water at 60° C. to proceed a dissociation reaction to obtain a reaction intermediate. The amount of the 98.0% sulfuric acid required for converting 1 kg of the secondary fly ashes into gypsum was 0.346 kg. The reaction intermediate having a pH value in the range of 2.5-3.0 was then cooled to 25° to proceed a crystallization reaction, thereby obtaining a reaction product of E1 that included a solid product and water. The solid product of E1 contained 94.38 wt % of gypsum ($CaSO_4.2H_2O$) and 4.01 wt % of inorganic materials after drying.

The compositions of the preliminary fly ashes, the secondary fly ashes, and the solid product are shown in Table 1.

Comparative Example 1 (CE1)

A sulfur-containing petroleum coke with a feeding rate of 42 ton/hr and limestone with a feeding rate of 30 ton/hr were added into a furnace of a CFBC. The furnace was heated to 900° C. so as to instantaneously generate a gaseous product and preliminary fly and bottom ashes at a rate of 30 ton/hr. 50 kg of the preliminary fly ashes was mixed with 38.9 kg of 98 wt % sulfuric acid and 150 kg of water at 60° C. to proceed a dissociation reaction to obtain a reaction intermediate. The amount of the 98.0% sulfuric acid required for converting 1 kg of the preliminary fly ashes into gypsum was 0.778 kg. The reaction intermediate having a pH value in the range of 2.5-3.0 was then cooled to 25° C. to proceed a crystallization reaction, thereby obtaining a reaction product of CE1 that included a solid product and water. The solid product of CE1 contained 94.38 wt % of gypsum ($CaSO_4.2H_2O$) and 4.01 wt % of inorganic materials after drying.

TABLE 1

| Component | Preliminary fly ash | Secondary fly ash | Solid product of E1 | Solid product of CE1 |
|---|---|---|---|---|
| $CaSO_4 \cdot 2H_2O$ | 0 | 0 | 94.38 | 94.38 |
| $CaSO_4$ | 39.87 | 61.31 | 0 | 0 |
| $CaCO_3$ | 16.19 | 5.65 | 0 | 0 |
| $Ca(OH)_2$ | 9.75 | 3.32 | 0 | 0 |
| CaO | 23.11 | 20.55 | 0 | 0 |
| Other inorganic materials | 8.06 | 7.34 | 4.01 | 4.01 |
| carbon | 3.02 | 1.83 | 1.61 | 1.61 |

As shown in Table 1, the mass fraction of $CaSO_4$ in the fly ashes increases from 39.87% to 61.31%. About a 21% increase in the mass fraction of $CaSO_4$ in the fly ashes is found. Furthermore, the amount of sulfuric acid required for converting 1 kg of the secondary fly ashes into gypsum in Example 1 is 0.346 kg, and the amount of sulfuric acid solution required for converting 1 kg of the preliminary fly ashes into gypsum in Comparative Example 1 is 0.778 kg. The amount of the sulfuric acid solution is significantly decreased in the method of this disclosure.

In conclusion, by hydrating the preliminary fly and bottom ashes to form the hydrated materials and recycling the hydrated materials into the furnace to form the secondary fly and bottom ashes, the sulfuric acid required for converting the fly ashes into gypsum can be significantly decreased.

While the present disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method of combusting a sulfur-containing carbonaceous material with ash treatment, comprising:

feeding a feed containing the sulfur-containing carbonaceous material and limestone into a furnace;

combusting the feed in the furnace so as to generate a gaseous product and preliminary fly and bottom ashes;

hydrating at least a portion of the preliminary fly and bottom ashes to form a hydrated material;

recycling the hydrated materials into the furnace so as to generate the gaseous product and secondary fly and bottom ashes;

reacting the secondary fly and bottom ashes with a sulfuric acid solution at a reaction temperature ranging from 50° C. to 80° C. to form a reaction intermediate; and cooling the reaction intermediate having a pH value ranging from 2.0 to 3.0 to a crystallization temperature ranging from 15° C. to 35° C. for a crystallization reaction to proceed, so as to form a reaction product including gypsum.

2. The method of claim 1, wherein the sulfur-containing carbonaceous material is petroleum coke or coal.

3. The method of claim 1, wherein the preliminary fly and bottom ashes contain 30 wt % to 60 wt % $CaSO_4$ based on the total weight of the preliminary fly and bottom ashes.

4. The method of claim 1, wherein the secondary fly and bottom ashes contain 60 wt % to 85 wt % $CaSO_4$ based on the total weight of the secondary fly and bottom ashes.

* * * * *